US006983933B2

(12) United States Patent
Klein et al.

(10) Patent No.: US 6,983,933 B2
(45) Date of Patent: Jan. 10, 2006

(54) SHEET-PROCESSING MACHINE WITH A SHEET BRAKE

(75) Inventors: Edmund Klein, Neckargemünd (DE); Peter Thoma, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 10/699,180

(22) Filed: Oct. 31, 2003

(65) Prior Publication Data

US 2004/0089997 A1 May 13, 2004

(30) Foreign Application Priority Data

Oct. 31, 2002 (DE) ..... 102 50 700

(51) Int. Cl.
*B65H 29/68* (2006.01)

(52) U.S. Cl. ..... 271/182; 271/183

(58) Field of Classification Search ..... 271/182, 271/183; 101/240

See application file for complete search history.

(56) References Cited

U.S. PATENT DOCUMENTS 4,991,832 A 2/1991 Spiegel et al.
5,673,911 A 10/1997 Loftus et al.
6,044,760 A 4/2000 Krüger
6,557,468 B2 5/2003 Kelm et al.
6,591,748 B2 * 7/2003 Kerpe et al. ..... 101/232
6,619,199 B2 9/2003 Merz et al.
6,648,326 B2 * 11/2003 Hieb ..... 271/183
6,746,014 B2 * 6/2004 Endo et al. ..... 271/204
2001/0008328 A1 7/2001 Gunschera et al.
2001/0022426 A1 * 9/2001 Lautenklos et al. ..... 271/182
2001/0026042 A1 * 10/2001 Kerpe et al. ..... 271/183

FOREIGN PATENT DOCUMENTS

DE 38 36 253 A1 4/1990
DE 44 35 988 A1 4/1996
DE 197 22 376 A1 12/1997
DE 197 58 446 A1 9/1998
DE 101 34 836 A1 2/2002
DE 101 46 924 A1 5/2002
EP 1 108 671 A2 6/2001

* cited by examiner

*Primary Examiner*—David H. Bollinger

(74) *Attorney, Agent, or Firm*—Laurence A. Greenberg; Werner H. Stemer; Ralph E. Locher

(57) ABSTRACT

A sheet-processing machine includes a delivery, a guide surface for sheets being processed and a sheet brake in the delivery. The sheet brake has at least one brake shoe movable over the guide surface.

16 Claims, 10 Drawing Sheets

SHEET-PROCESSING MACHINE WITH A SHEET BRAKE

BACKGROUND OF THE INVENTION

Field of the Invention

The invention relates to a sheet-processing machine having a delivery including a sheet brake. Such a machine may, for example, be a sheet-fed offset printing press, such as is described in German Published, Non-prosecuted Patent Application DE 101 46 924 A1 corresponding to U.S. Pat. No. 6,619,199.

In the delivery of such a sheet-fed printing press, the leading edge of the printed sheet is guided, for example, by grippers on a gripper bar, until the sheet is above the pile or stack onto which the sheet is subsequently to be deposited. In order to brake the sheet, from the speed at which it is delivered, to such an extent that it can be deposited on the pile or stack gently and in a controlled manner, braking devices are provided, which are known as braking modules. Those are, for example, suction disks or suction belts, with which the sheet comes into contact and then is braked either by friction or in such a manner that the revolving suction belt is retarded after the sheet has arrived. Such suction belts, which are controlled by retardation, are described in the European Patent Application EP 1 108 671 A2 corresponding to U.S. Patent Application Publication No. U.S. 2001/008328 A1 and German Published, Non-prosecuted Patent Application DE 44 35 988 A1, for example.

In so-called verso or perfector printing, the oncoming sheets in the delivery are printed on both sides thereof with ink which is still fresh. Braking devices or braking modules, therefore, have to be disposed in such a manner that they bear on the underside of the sheet only in print-free areas or regions thereof, in order to avoid impairment of the printed image and smearing of the ink. However, the position of a print-free area or region depends upon the configuration of the copies on the printed sheet and therefore differs in accordance with the respective print job. Consequently, the braking modules in the delivery are regularly adjustable and positionable transversely to the sheet conveying direction.

In particular when operations are carried out with only a few braking modules in the delivery, the sheet may sag between the braking modules, so that the sheet, with the printed image thereof, grazes components of the machine, which leads, as well, to smearing of the printed image, and is unacceptable. In such cases, it is necessary to support the sheet in the regions between the braking modules. So-called guide loops and small spur wheels have become known for that purpose.

When they come into contact with the printed image, the latter is not smeared. However, that contact also results in a certain marking of the printed image, which is not always acceptable.

It has therefore become known to bridge the interspaces between the braking modules by sheet guide plates, which are dimensioned in such a way that they respectively close the interspace between each pair of adjacent braking modules. Thus, an air cushion can be formed between the individual sheet guide plates and the underside of the sheet, and permits smear-free sheet transport. However, working with such guide plates is time-consuming and difficult because they can be installed only when the individual braking modules have been preset to the then-provided subject and the print-free regions on the sheet, respectively.

Furthermore, the guide plates must be tailor-made to the respective spaced distance between the braking modules. A large number of plates of different widths are therefore needed from print job to print job. Against that background, there has been proposed in German Published, Non-prosecuted Patent Application DE 101 34 836 A1, corresponding to U.S. Pat. No. 6,557,468, the provision of a belt of flexible material as a supporting element between the braking modules. The length of the belt is adaptable, in a direction transverse to the sheet conveying direction, to the spaced distance between the mutually adjacent braking modules.

An air cushion supporting the sheets and the sagging parts thereof and, therefore, preventing the undersides of the sheets from being smeared, may then be built up above that flexible belt. In the case of that device, the braking modules can be adjusted by remote control, without manual intervention, to the print-free area or region in the subject of the sheet. However, such devices are relatively complicated, and present problems, for example, in supplying the air for the supporting air cushion between the braking modules.

SUMMARY OF THE INVENTION

It is accordingly an object of the invention to provide a sheet brake in the delivery of a sheet-processing machine, which overcomes the hereinafore-mentioned disadvantages of the heretofore-known devices of this general type and which is configured in such a way that it can be set by remote control to the print-free areas or regions as simply as possible.

With the foregoing and other objects in view, there is provided, in accordance with the invention, a sheet-processing machine, comprising a delivery, a guide surface for sheets being processed, and a sheet brake in the delivery. The sheet brake has at least one brake shoe movable over the guide surface.

In accordance with another feature of the invention, the brake shoe is movable transversely to a conveying direction of the sheets.

In accordance with a further feature of the invention, the brake shoe is movable parallel to a conveying direction of the sheets.

In accordance with an added feature of the invention, the brake shoe is movable cyclically in and counter to the sheet conveying direction.

In accordance with an additional feature of the invention, the brake shoe is movable in a delayed or decelerated or retarded manner in the sheet conveying direction.

In accordance with yet another feature of the invention, the brake shoe has a height selected from less than to only slightly greater than a spaced distance between the guide surface and a respective sheet floatingly guided thereabove.

In accordance with yet a further feature of the invention, the machine further includes at least one linear motor for driving the at least one brake shoe.

In accordance with yet an added feature of the invention, the linear motor has a stator part and a rotor part. The stator part is disposed beneath the guide surface. The rotor part is disposed in or on the brake shoe.

In accordance with an additional feature of the invention, the guide surface is formed of non-magnetizable material.

In accordance with still another feature of the invention, the machine further includes air nozzles provided in the guide surface.

In accordance with still a further feature of the invention, the brake shoe is connected to a suction air source.

In accordance with still an added feature of the invention, the machine further includes a guide for guiding the brake shoe therein parallel to the sheet conveying direction. The guide has a support by which the guide is engaged in a U-shaped manner around an end of the guide surface.

In accordance with still an additional feature of the invention, the support of the guide is adjustable transversely to the guide direction.

In accordance with another feature of the invention, the guide has a fork-shaped configuration. The brake shoe around which the guide engages lies laterally on the guide surface.

In accordance with a further feature of the invention, the brake shoe lies via an air-cushion bearing on the guide surface.

In accordance with an added feature of the invention, the machine further includes nozzles provided in the guide surface for producing the air cushion.

In accordance with an additional feature of the invention, the brake shoe lies via a magnetic bearing without contact on the guide surface.

In accordance with yet another feature of the invention, the linear motor is an electromagnetic or pneumatic linear motor.

In accordance with a concomitant feature of the invention, the machine is a sheet-fed printing press.

Thus, according to the invention, the sheet brake includes one or more brake shoes which are movable over the guide surface for the sheet. In this regard, in a departure from the constructions known heretofore in the state of the art, the brake shoe is constructed so flat that the guide surface can be guided uninterruptedly into the region of the braking modules. The brake shoe, therefore, expediently has a height which is less than or only slightly greater than the distance between the conveyed sheet floating on an air cushion, and the guide surface itself.

In this way, the brake shoe and the plurality of brake shoes the print-free area or region of the sheet, transversely to the sheet conveying direction. In addition or instead, in a particularly advantageous further development of the invention, if no transverse adjustment is required at all, it is also possible to move the flat brake shoes parallel to the sheet conveying direction, and indeed advantageously cyclically and with retardation counter to the sheet conveying direction. In this way, an actively driven sheet brake which does not penetrate the uninterrupted sheet guide surface can be realized.

It is particularly advantageous if the brake shoe and the plurality of brake shoes are respectively driven by one or more linear motors. For example, the stator part of such a linear motor can be disposed underneath the guide surface, and the rotor part can be disposed in or on the brake shoe. If the guide surface is composed of non-magnetizable material, such as an aluminum or a plastic part, the stator and the rotor can interact with the magnetic field lines thereof through the guide surface, and the brake shoe then moves reciprocatingly over the guide surface in a manner similar to a magnetic suspension railroad.

In addition, the braking modules with suction belts heretofore known in the prior art are not wear-free. On the contrary, the belts have to be replaced from time t time. On the other hand, the brake shoes, depending upon the contruction thereof, are moved over the guide surface without mechanical contact and are consequently subjected to virtually no wear.

Other features which are considered as characteristic for the invention are set forth in the appended claims.

Although the invention is illustrated and described herein as embodied in a sheet-processing machine with a sheet brake, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
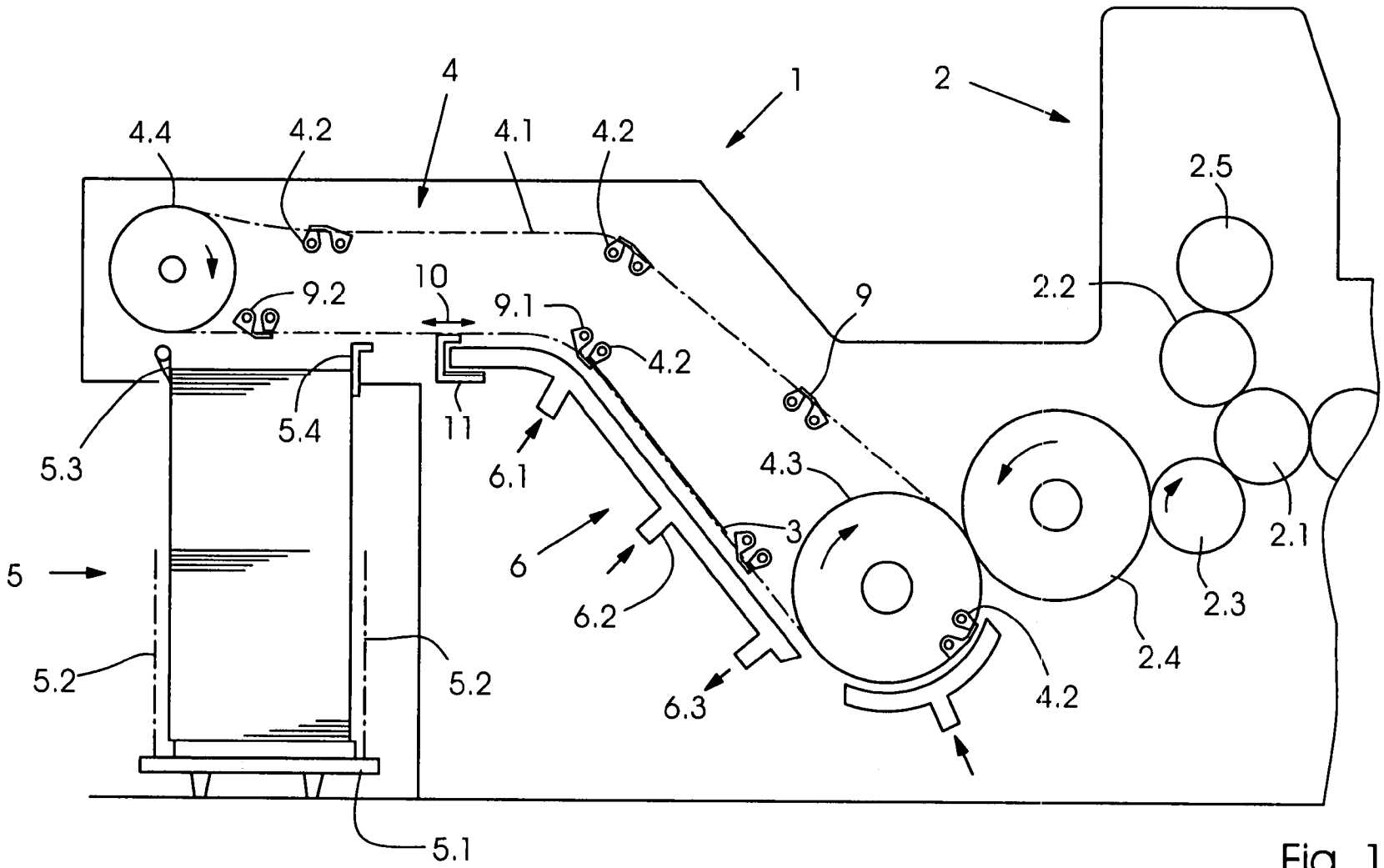
FIG. 1 is a fragmentary, diagrammatic, side-elevational view of a delivery of a sheet-fed printing press.

Referring now to the figures of the drawings in detail and first, particularly, to FIG. 1 thereof, there is seen a so-called chain delivery 1 connected downstream of a printing unit 2 of a sheet-fed offset printing press. The printing unit 2 includes an impression cylinder 2.1, a blanket cylinder 2.2, a plate cylinder 2.5, a single-turn transfer drum 2.3 and a half-turn transfer drum 2.4. Other constituent parts of the printing unit 2; such as a dampening unit, an inking unit, and so forth, have been omitted in the interest of clarity. Individual printed sheets 3 are transported onwardly from the printing unit 2 to a stacking or piling device 5 by a chain conveyor 4. The stacking or piling device 5 has a platform 5.1 and lifting chains 5.2, as well as a leading edge stop 5.3 and a trailing edge stop 5.4. The chain conveyor 4 includes, among other things, a conveyor chain 4.1 on each side of the delivery 1, gripper bars 4.2, which are fixed on both sides to the conveyor chains 4.1, two drive sprockets 4.3 and two deflection sprockets 4.4 above the stacking or piling device 5 for the printed sheets 3.

In a rising region of the chain delivery 1, a sheet guide, guiding device or guide surface 6 is disposed at a slightly spaced distance respectively underneath the conveyor chains 4.1 and the gripper bars 4.2 fixed thereto. The sheet guide device 6 is hollow and has two inlet stubs 6.1 and 6.2 and an outlet stub 6.3 for respectively supplying and discharging blast or blown air. The sheet guide device 6 is provided with blower or blast nozzles that are not illustrated in FIG. 1, on a side of the sheet guide device 6 facing towards the sheet 3. The blast or blown air flowing out thereat ensures that the sheet gripped by grippers 9.2 on the gripper bar 4.2 and transported in the direction towards the stacking or piling device 5 floats over the sheet guide device 6 and is thus transported contact-freely in the direction towards the stack or pile.

An important element of the delivery 1 is a braking device 11 wherein, as is yet to be described in accordance with the following figures of the drawings, brake shoes, which are reciprocatingly movable in the direction of an arrow 10, apply suction to or attract the incoming sheet 3 by suction in a rear region thereof and retard the sheet 3. Meanwhile, the grippers open in the position shown for a gripper 9.2, for example, and release the sheet 3 above the sheet pile or stack.

Figure 2:
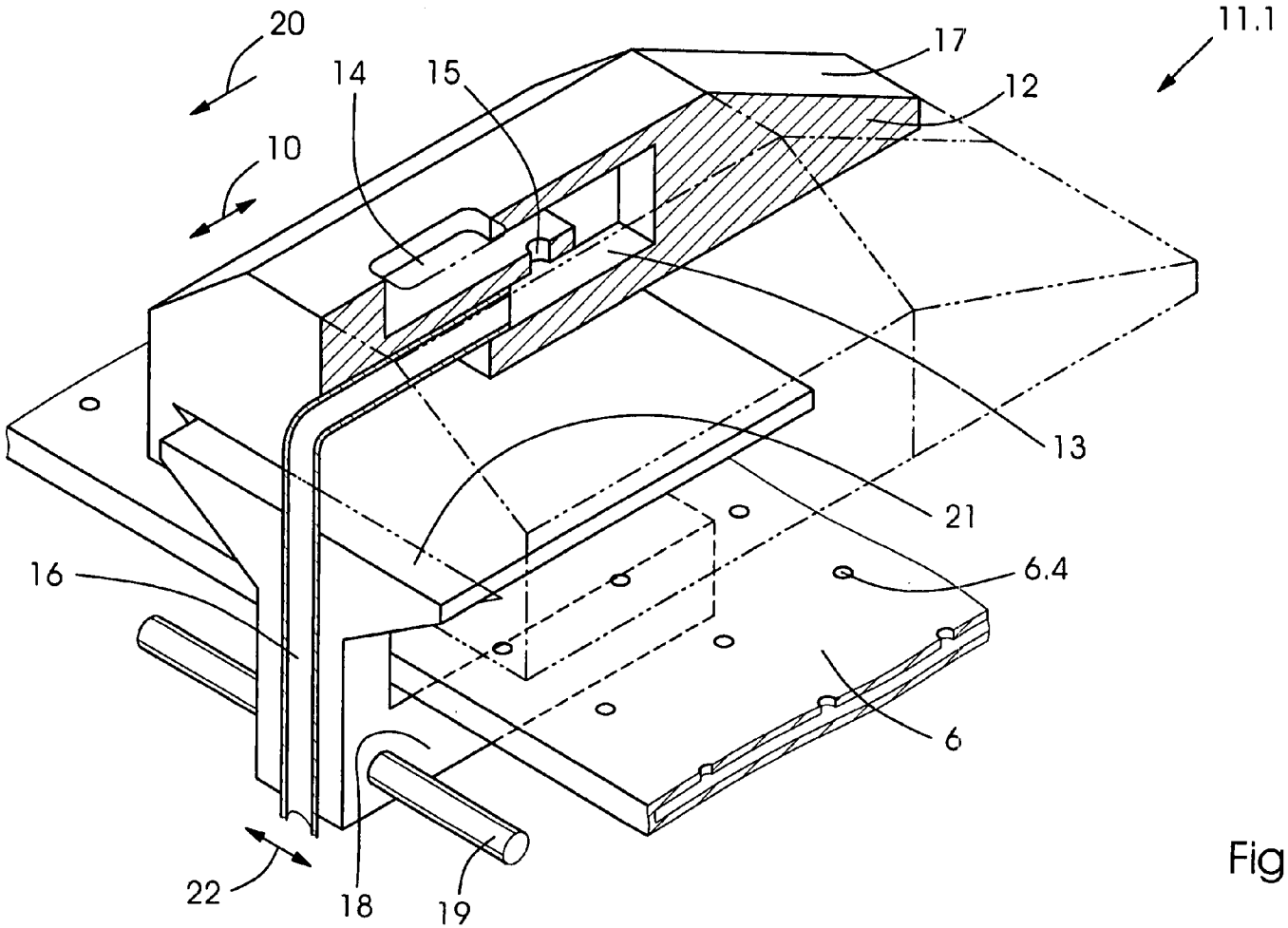
FIG. 2 is an enlarged, fragmentary perspective view, partly in section, of FIG. 1, showing a module of a braking device according to a first exemplary embodiment of the invention.

The braking device 11 includes a plurality of modules, for example two, three or four modules, of which one module 11.1 is shown in FIG. 2. The illustration of FIG. 2 is not shown to scale and is exaggerated in order to be able better to explain the details in the construction.

The braking module 11.1 has a guide 21 for a brake shoe 12, which is movable in the direction of the arrow 10. The guide 21 engages in a fork-shaped manner around the sheet guide device 6, which is formed with blast or blown air nozzles 6.4, at an end thereof located on the side of the pile or stack.

The fork-side guide 21 is, for its part, in turn displaceable, by guide rods, which are not shown in FIG. 2, perpendicularly to a sheet travel direction represented by an arrow 22, in a region 18 of the fork located under the guide device 6 and, with the aid of a threaded spindle 19, can be displaced into a print-free region of the sheet to be braked.

In the interior of the brake shoe 12, which is movable on the guide 21, there is provided a suction chamber 13 which is connected via a suction tube 16 to a vacuum source and supplies the suction chamber 13 with vacuum cyclically at the cycle rate of the incoming sheets via valves controlled by the printing press but not illustrated in FIG. 2. The suction chamber 13 terminates in or opens into a suction opening 14 formed on the upper side of the brake shoe 12. On the front side of the brake shoe 12, facing towards the oncoming sheet, the brake shoe 12 has an oblique or inclined flattened surface 17, over which the sheet underside slides onto the brake shoe 12. When the rear region of the brake shoe 12 covers the suction opening 14, the vacuum is switched to "apply suction", and the sheet underside is drawn onto the upper side of the brake shoe 12. This occurs while the brake shoe 12 has already been set moving, as indicated by the arrow 20, and has matched the speed of the paper sheet, not illustrated in FIG. 2. Provided for the suction chamber 13 is a ventilation hole 15, the function of which is yet to be explained in connection with FIGS. 4*a* to 4*e*.

The brake shoe 12 is driven by an electromagnetic linear drive, the stator provided with the coil windings being integrated into the guide 21 and the rotor equipped with the permanent magnets being inserted into the underside of the brake shoe 12. Suitable electromagnetic linear drives have become known heretofore and are sold, for example, by the firm Jung Antriebstechnik und Automation GmbH in D-35435 Wettenberg, Germany, under the designation LSD (modular linear directly driven servo drives) with an integrated position registering system and position controller, as well as integrated linear guides.

With such linear motors, high accelerations and retardations can be achieved and, therefore, the brake shoe 12 can be moved cyclically reciprocatingly on the guide 21 at the cycle rate of the oncoming sheets of up to five sheets per second currently required for offset printing presses.

The course of movement of the brake shoe 12 and the instants of time for gripper actuation, the application of vacuum, and so forth, are prescribed by the machine control system of the printing press in accordance with a program stored therein. Hereinafter, the course of a cycle will be explained in accordance with the plotted movement diagram or graph shown in FIG. 3 and the pictorial illustrations according to FIGS. 4*a* to 4*f*.

Figure 3:
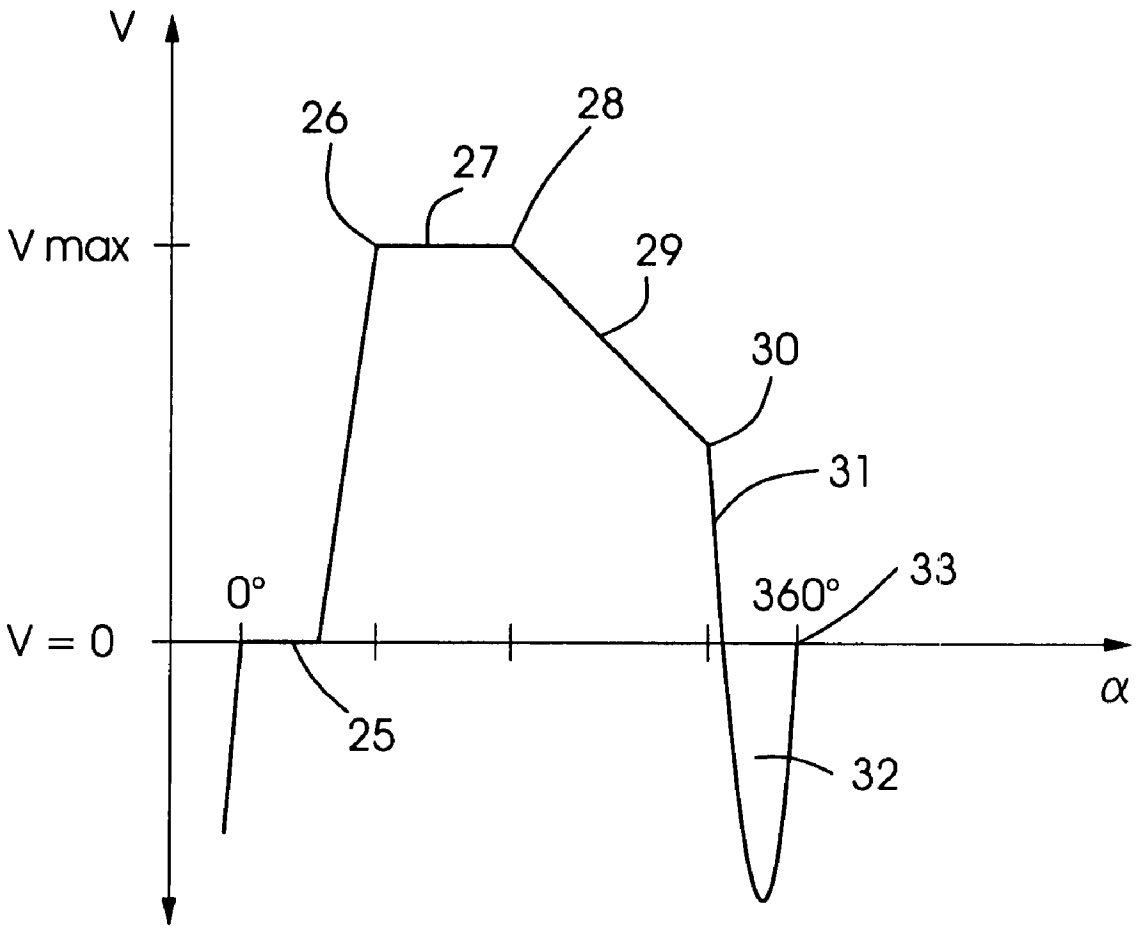
FIG. 3 is a velocity graph or plot diagram for a course of movement of a brake shoe of the braking device in FIG. 2 over a sheet deposit cycle (i.e., a machine angle $\alpha$=360°)
Figure 4A:
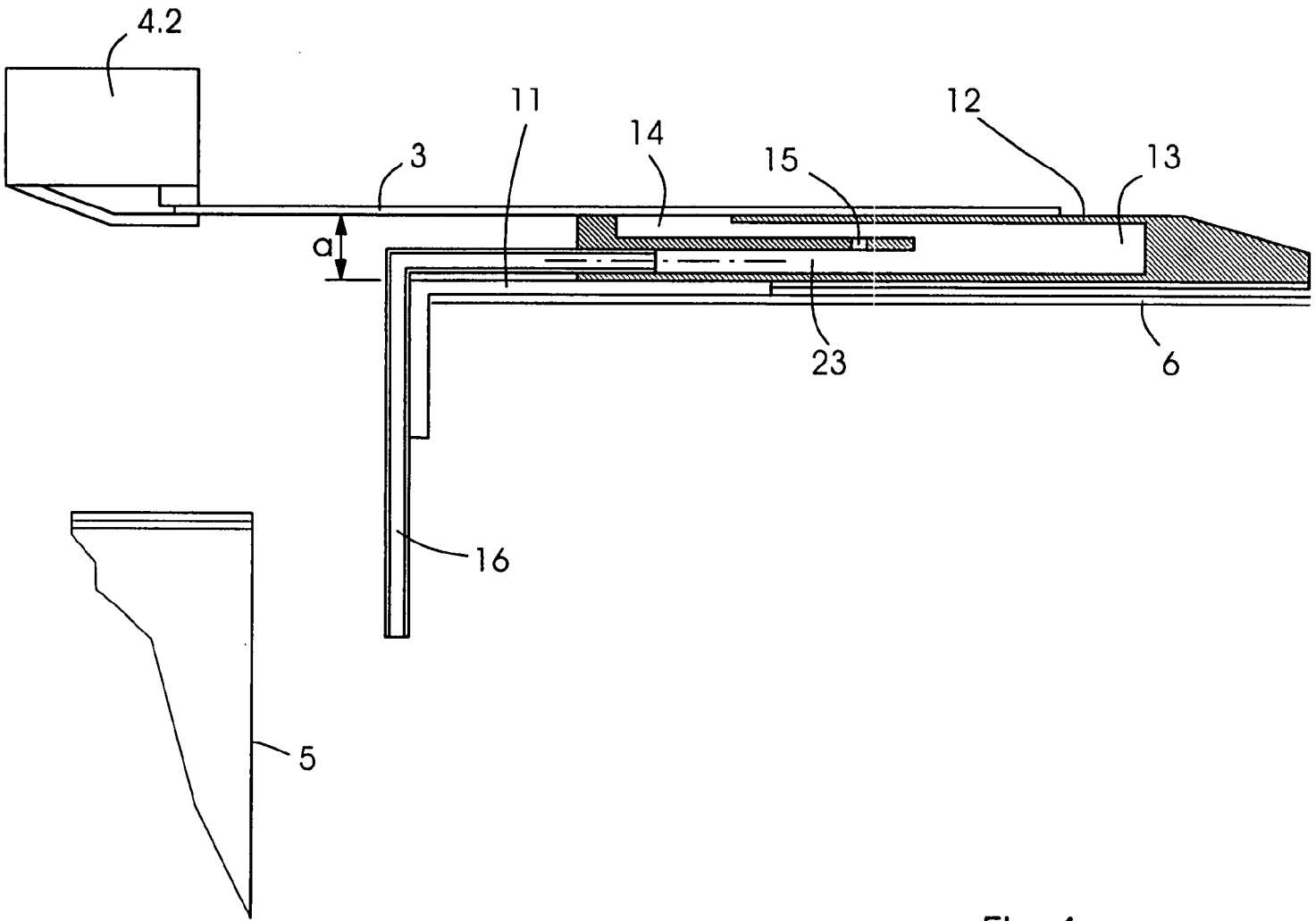
FIGS. 4A to 4F are diagrammatic, side-elevational views, partly in section, of FIG. 2 showing the brake shoe in various positions thereof during the movement thereof in the course of one cycle.
Figure 4B:
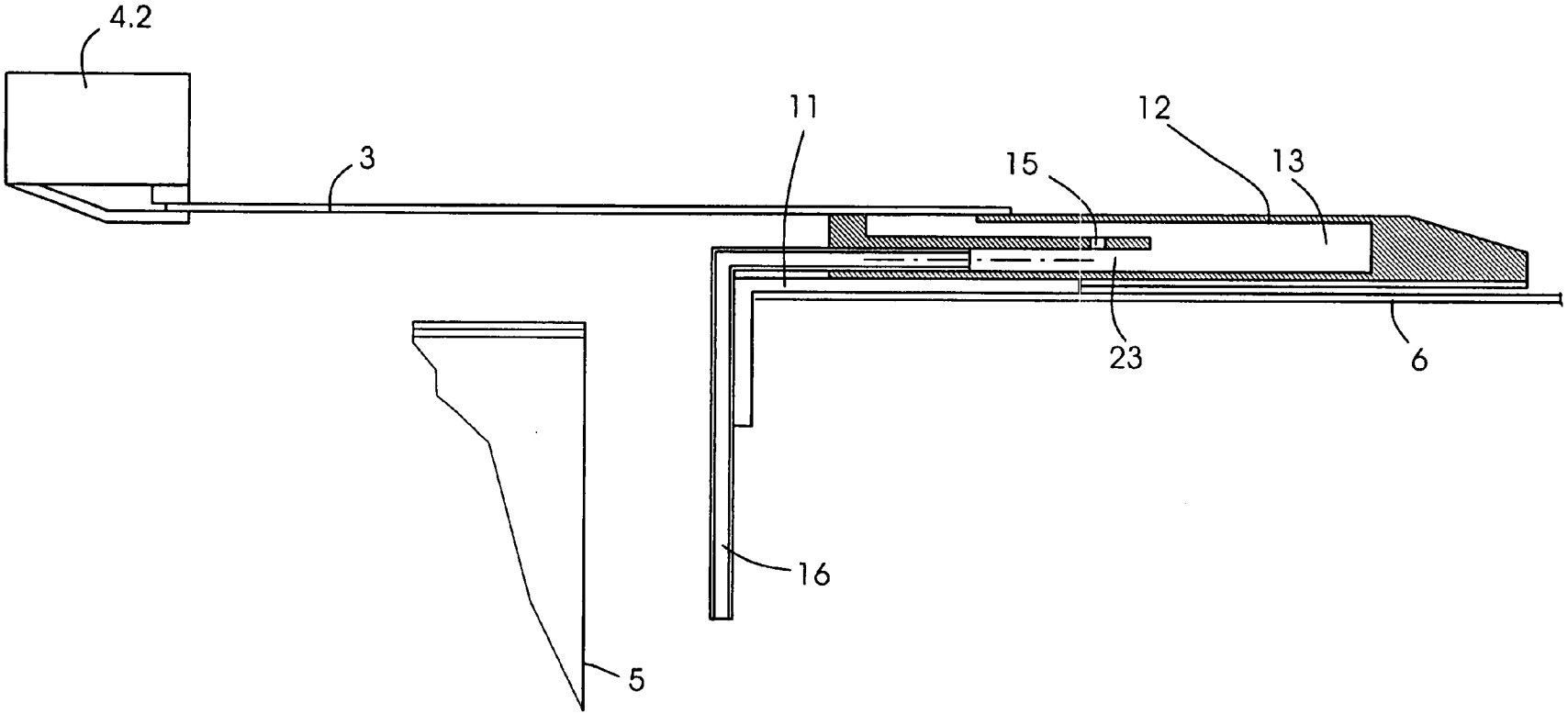

At the start of the cycle, the brake shoe 12 is in a completely withdrawn position away from the sheet pile or stack 5 as shown in FIG. 4*a*, at rest or in a phase of movement reversal represented at 25 in FIG. 3. In this regard, the sheet 3 is already sweeping with the print-free region thereof over the brake shoe 12. The brake shoe 12 then accelerates to sheet speed and reaches the sheet speed approximately at the time that the end of the sheet comes to lie over the suction opening 14 as shown in FIG. 4*b*, at the instant of time represented at 26 in FIG. 3.

Figure 4C:
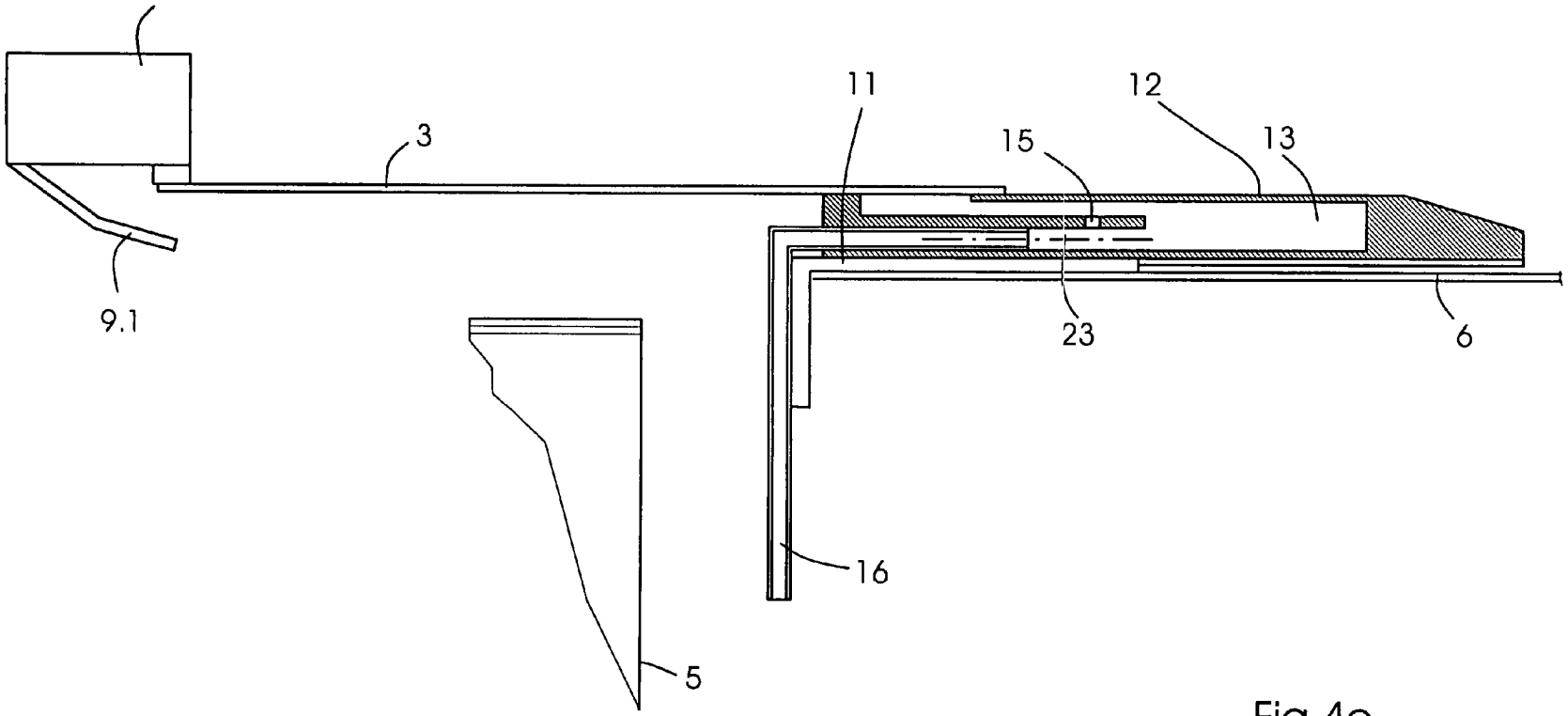

The brake shoe 12 then follows the end of the sheet (note reference numeral 27 in FIG. 3), and the vacuum is switched on, whereupon the sheet is firmly caused to adhere by suction to the surface of the brake shoe 12. The grippers 9.2 of the gripper bar 4.2 then open, as shown in FIG. 4*c*, at the instant of time 28 in FIG. 3, and release the leading edge of the sheet.

Figure 4D:
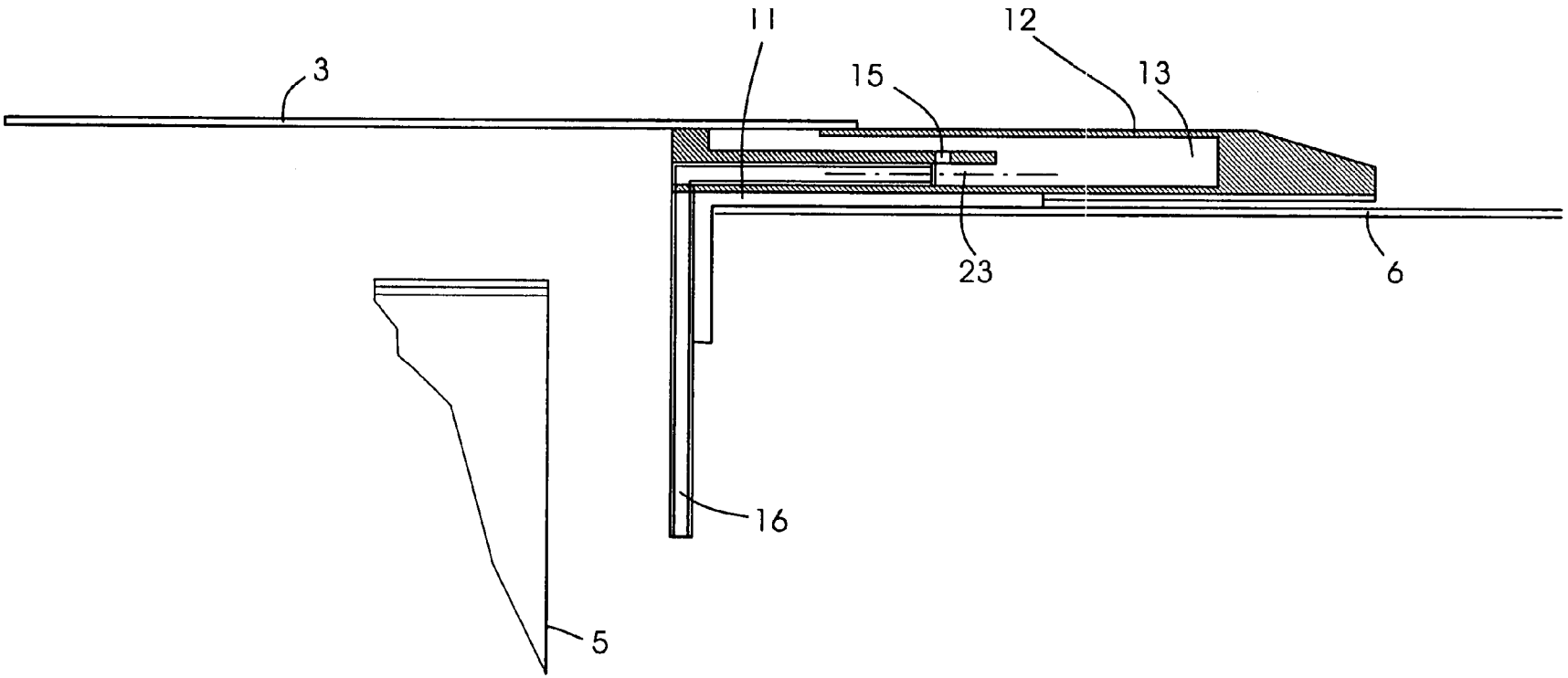

Thereafter, the brake shoe 12 carries out a retarded movement, as shown in FIG. 4*d*, at the instant 29 in FIG. 3, and brakes the sheet 3 over the sheet pile or stack 5.

Figure 4E:
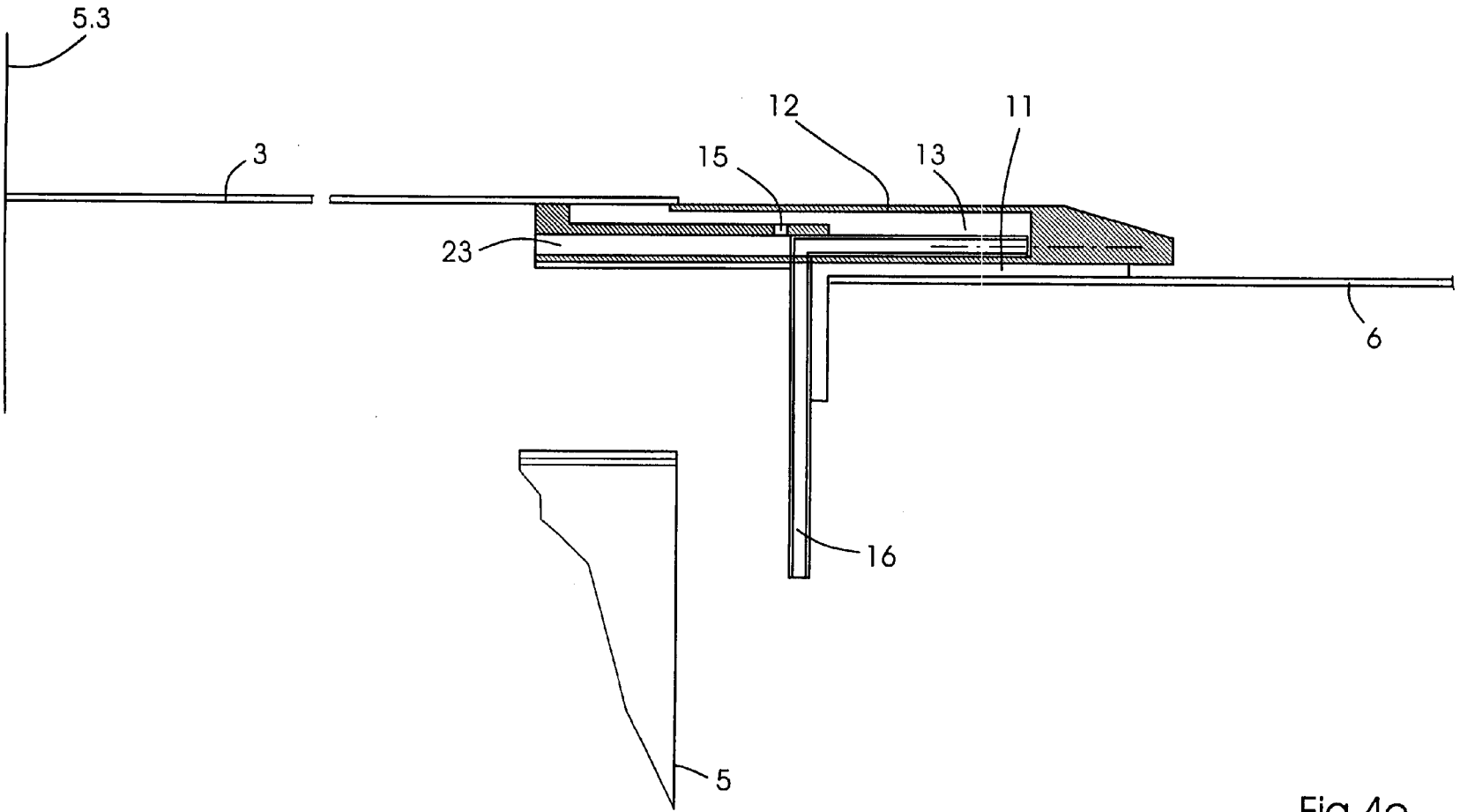
Figure 4F:
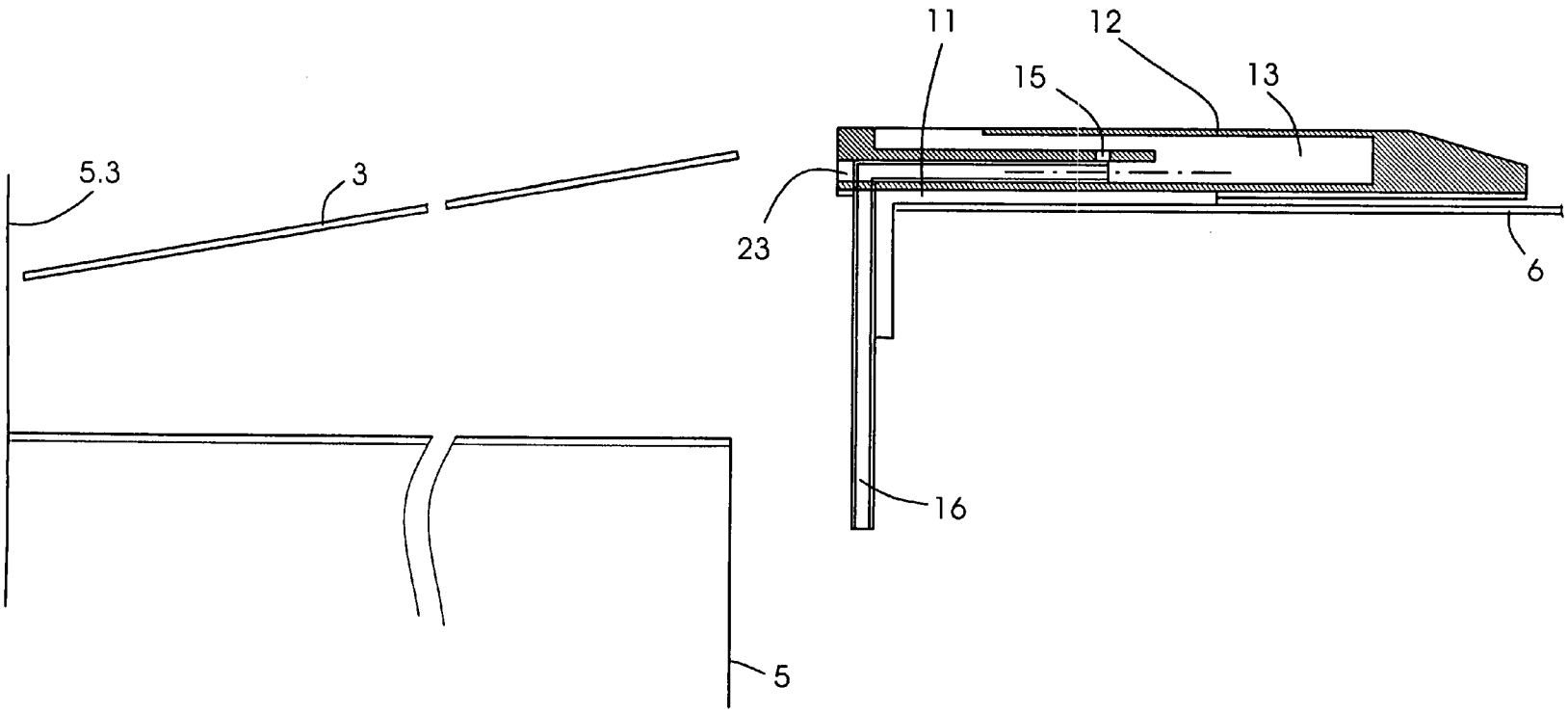

At the end of this path of movement of the brake shoe 12, the latter with the suction opening 14 has already moved beyond the end of the sheet guide device 6 over the sheet pile or stack 5. Here, the brake shoe 12 releases the sheet 3, as shown in FIG. 4*e*, at the instant 30 in FIG. 3, because the vacuum in the suction chamber is either switched off or, as shown in this exemplary embodiment, the suction tube 16 projecting into the brake shoe releases the ventilation hole 15, which communicates with normal pressure via the open duct 23 on the pile or stack side. While the brake shoe 12 is then braked to 0 speed at 31 in FIG. 3, and, reverses, as shown in FIG. 4*f*, the direction of movement thereof, during the time 32 in FIG. 3, the braked sheet 3 falls onto the sheet pile or stack surface and engages with the sheet leading edge stops 5.3.

The brake shoe 12, as shown in FIG. 4*a* then reaches the initial position thereof again at 33 in FIG. 3, while the next sheet has already arrived, and the cycle begins again.

Figure 5:
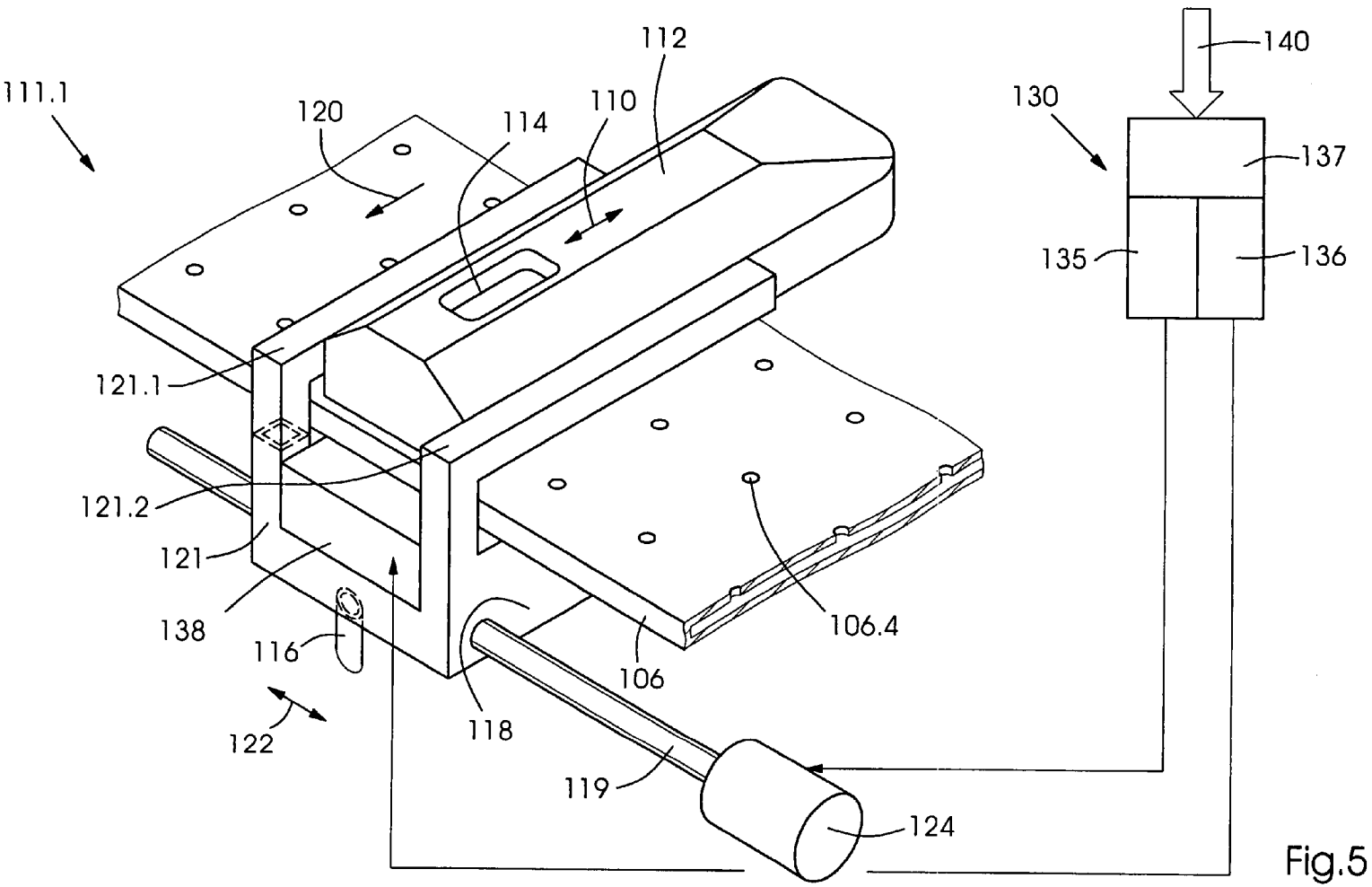
FIG. 5 is a perspective view similar to that of FIG. 2 of an exemplary embodiment of the invention which is modified with respect to the embodiment shown in FIG. 2.

In the exemplary embodiment according to FIG. 5, a braking module which is particularly compact and flat in comparison with that of FIG. 2 is illustrated. Identical parts are provided with a reference number which is higher by 100 compared with those in FIG. 2 and will consequently not be described again here. However, it is worthy of mention that a sheet guide device or guide surface 106 is composed herein of non-magnetizable material, for example of a plastic or aluminum sheet. In the upper region thereof located above the sheet guide device 6, the guide part 121 is formed with two parallel prongs 121.1 and 121.2, between which the brake shoe 112 is seated and by which the brake shoe 112 is guided laterally. The brake shoe 112 is seated directly on the surface of the sheet guide device 106 and is guided vertically in the manner of a fluid bearing, for example by the air emerging from the blast or blown air nozzles 106.4 or the air cushion which is produced. The prestressing of the fluid bearing is achieved by magnetic forces.

The stator part 138 of the linear motor for the drive of the brake shoe 112 is located in the lower region 118 of the guide part 121. The field lines of the stator reach through the sheet guide device 106 and, if energized suitably, then move the brake shoe 112 in accordance with the cycle illustrated in FIGS. 3 and 4*a* to 4*f*.

Vacuum is supplied to the suction opening 114 as follows: the prong 121.1 of the fork-shaped guide 121 is hollow and is connected to the suction tube 116. At the front end of the prong 121.1, on the inside, the hollow cavity thereof ends in an opening which is not visible in FIG. 5. Opposite the latter, the brake shoe 112 is formed with a longitudinal slot. The position of the opening and the length of the slot may be selected so that, in a manner similar to that of the ventilation hole 15 in FIG. 2 and FIGS. 4*a* to 4*f*, when the brake shoe is moved into the pile or stack-side end position, the opening is closed and the slot is opened and vented by ambient air.

For the purpose of lateral adjustment to the print-free regions of the sheets, the guide part 121 for the brake shoe 112 is moved with the aid of a motor 124 via a threaded spindle 119. The motor 124 is actuated by a motor controller 135 in an electronics unit 130. This electronics unit 130 also contains the control electronics 136 for actuating the stator 138 of the linear drive for the brake shoe 112. The signals for this purpose are obtained by the two electronic controllers 135 and 136 via an interface 137, which is connected to a signal bus 140 of the printing-press control system. From there, the setting operations and also the machine angle which controls the movement of the brake shoe 112 are prescribed.

Modifications of the exemplary embodiments described in the figures of the instant application lie entirely within the scope of the invention. For example, instead of the spindle drive described in FIG. 2 and the aforementioned guide rods for the lateral movement of the part 21 or 121, a series of cables or chains can be used in conjunction with other conventional guide rails. Instead of the electromagnetic linear motor for the drive to the brake shoe, other linear drives, for example pneumatic linear drives, can also be used and, for the non-contacting or friction-free mounting of the brake shoe, magnetic bearings can be used and, particularly advantageously, combined with the electromagnetic linear drive.

We claim:

1. A sheet-processing machine, comprising:
a delivery;
a guide surface for sheets being processed; and
a sheet brake in said delivery, said sheet brake having at least one brake shoe movable over said guide surface parallel to a conveying direction of the sheets and cyclically in and counter to the sheet conveying direction.

2. The machine according to claim 1, wherein said brake shoe is movable transversely to the conveying direction of the sheets.

3. The machine according to claim 1, wherein said at least one brake shoe is movable in a retarded manner in the sheet conveying direction.

4. A sheet-processing machine, comprising:
a delivery;
a guide surface for sheets being processed; and
a sheet brake in said delivery, said sheet brake having at least one brake shoe movable over said guide surface, said at least one brake shoe having a height of from less than to only slightly greater than a spaced distance between said guide surface and a respective sheet floatingly guided thereabove.

5. A sheet-processing machine, comprising:
a delivery;
a guide surface for sheets being processed;
a sheet brake in said delivery, said sheet brake having at least one brake shoe movable over said guide surface; and
at least one linear motor for driving said at least one brake shoe.

6. The machine according to claim 5, wherein said linear motor has a stator part and a rotor part, said stator part being disposed beneath said guide surface, and said rotor part being disposed at a location selected from the group consisting of in and on said at least one brake shoe.

7. The machine according to claim 5, wherein said at least one linear motor is selected from the group consisting of electromagnetic and pneumatic linear motors.

8. A sheet-processing machine, comprising:
a delivery;
a guide surface formed of non-magnetizable material for sheets being processed; and
a sheet brake in said delivery, said sheet brake having at least one brake shoe movable over said guide surface.

9. A sheet-processing machine, comprising:
a delivery;
a guide surface for sheets being processed;
a sheet brake in said delivery, said sheet brake having at least one brake shoe movable over said guide surface; and
a guide for guiding said at least one brake shoe therein parallel to the sheet conveying direction, said guide having a support engaging in a U-shaped manner around an end of said guide surface.

10. The machine according to claim 9, wherein said support of said guide is adjustable transversely to said guide direction.

11. The machine according to claim 9, wherein said guide has a fork-shaped configuration, and said brake shoe around which said guide engages lies laterally on said guide surface.

12. The machine according to claim 11, wherein said at least one brake shoe lies on said guide surface, and an air-cushion bearing is disposed between said at least one brake shoe and said guide surface.

13. The machine according to claim 12, further comprising nozzles provided in said guide surface for producing said air cushion.

14. The machine according to claim 11, wherein said at least one brake shoe lies without contact on said guide surface, and a magnetic bearing is disposed between said at least one brake shoe and said guide surface.

15. A sheet-fed printing press, comprising:
a delivery;
a guide surface for sheets being processed in the sheet-fed printing press;
air nozzles provided in said guide surface; and
a sheet brake in said delivery, said sheet brake having at least one brake shoe movable over said guide surface parallel to a conveying direction of the sheets.

16. In a sheet-processing machine,
a delivery comprising:
a guide surface for sheets being processed; and
a sheet brake having at least one brake shoe movable over said guide surface parallel to a conveying direction of the sheets, and said brake shoe being connected to a suction air source.

* * * * *